US011027302B2

(12) United States Patent
Rosenbaum et al.

(10) Patent No.: US 11,027,302 B2
(45) **Date of Patent: *Jun. 8, 2021**

(54) SPRAYER NOZZLE SUPPORT

(71) Applicant: K&N Engineering, Inc., Riverside, CA (US)

(72) Inventors: Amir Rosenbaum, Los Altos, CA (US); Dave Johnston, Riverside, CA (US); Steve Williams, Beaumont, CA (US)

(73) Assignee: K&N Engineering, Inc., Riverside, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/253,493

(22) Filed: Jan. 22, 2019

(65) Prior Publication Data

US 2019/0151878 A1 May 23, 2019

Related U.S. Application Data

(63) Continuation of application No. 14/857,672, filed on Sep. 17, 2015.

(60) Provisional application No. 62/053,664, filed on Sep. 22, 2014.

(51) Int. Cl.
*B05B 11/00* (2006.01)

(52) U.S. Cl.
CPC ..... *B05B 11/3059* (2013.01); *B05B 11/0008* (2013.01); *B05B 11/3011* (2013.01)

(58) Field of Classification Search
CPC ..... B05B 11/3059; B05B 11/0008; B05B 11/3011; B05B 11/0032; B05B 11/3057; B05B 11/0027; B65D 83/201; B65D 83/22
USPC .. 222/153.13, 384, 383.1, 321.8, 321.9, 402
See application file for complete search history.

(56) References Cited

U.S. PATENT DOCUMENTS 4,373,644 A * 2/1983 Bennett ..... B05B 11/3059 222/153.13
4,479,589 A 10/1984 Ford
4,781,311 A 12/1988 Dunning et al.
4,917,303 A 4/1990 Maas et al.
4,944,429 A 7/1990 Bishop et al.
(Continued)

FOREIGN PATENT DOCUMENTS

EP 1317963 5/2009
WO 2007/008375 4/2007

*Primary Examiner* — Charles P. Cheyney
(74) *Attorney, Agent, or Firm* — Rutan & Tucker LLP; Hani Z. Sayed

(57) ABSTRACT

An apparatus and a method are provided for a sprayer nozzle support to a pump mechanism of a trigger sprayer assembly. The sprayer nozzle support generally comprises a tower portion and a first and second side protrusions. The tower portion is configured to convey stability to the pump mechanism when a screw cap of the trigger sprayer assembly is screwed onto a neck of a container. A top of the tower portion is configured to support the pump mechanism and a bottom of the tower portion is configured to contact the screw cap. The first and second side protrusions provide structures whereby the sprayer nozzle support may be removed from the trigger sprayer assembly. A curved proximal surface of the tower portion and the first and second side protrusions facilitates an unobstructed grasping of the trigger sprayer assembly in a hand.

9 Claims, 2 Drawing Sheets

(56) References Cited

U.S. PATENT DOCUMENTS

| | | | | |
|---|---|---|---|---|
| 5,143,236 | A | 9/1992 | Gueret | |
| 5,152,436 | A | 10/1992 | Hurksman et al. | |
| 5,445,299 | A * | 8/1995 | Harriman | B05B 11/306 215/254 |
| 5,562,250 | A * | 10/1996 | O'Neill | B05B 11/3004 222/136 |
| 5,626,259 | A * | 5/1997 | Maas | B05B 11/3011 222/136 |
| 5,725,132 | A * | 3/1998 | Foster | B05B 11/001 222/383.1 |
| 5,823,395 | A * | 10/1998 | Foster | B05B 11/3011 222/153.02 |
| 5,975,370 | A | 11/1999 | Durliat | |
| 6,003,738 | A | 12/1999 | Foster et al. | |
| 6,685,115 | B1 | 2/2004 | Hardin | |
| 7,854,352 | B2 | 12/2010 | Davies et al. | |
| 8,333,288 | B2 | 12/2012 | Miller et al. | |
| 8,474,663 | B2 | 7/2013 | Westphal | |
| 8,651,335 | B2 | 2/2014 | Llesera | |
| 8,757,447 | B2 * | 6/2014 | Gill | B05B 11/0027 222/1 |
| 2006/0113327 | A1 * | 6/2006 | Walters | B05B 11/3014 222/153.11 |
| 2011/0017846 | A1 | 1/2011 | Baxter et al. | |

* cited by examiner

FIG. 1
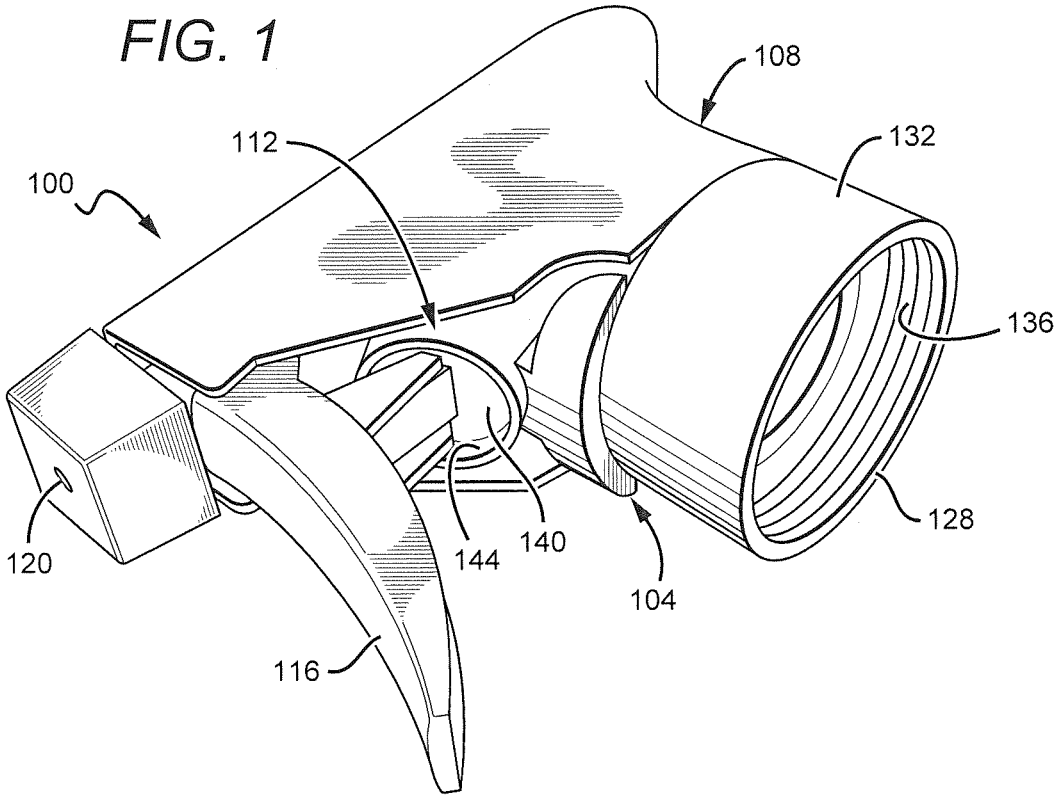
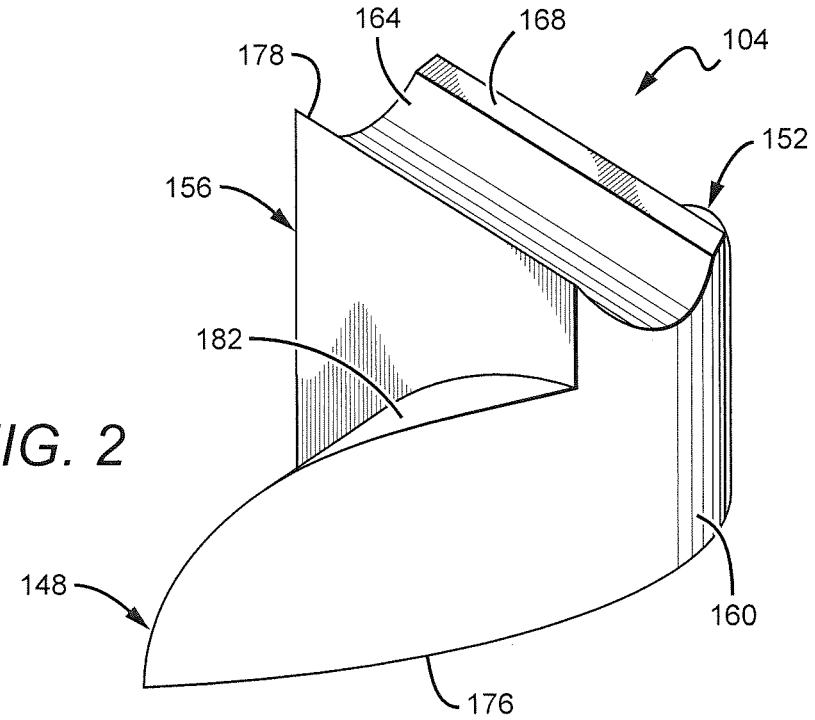
FIG. 2

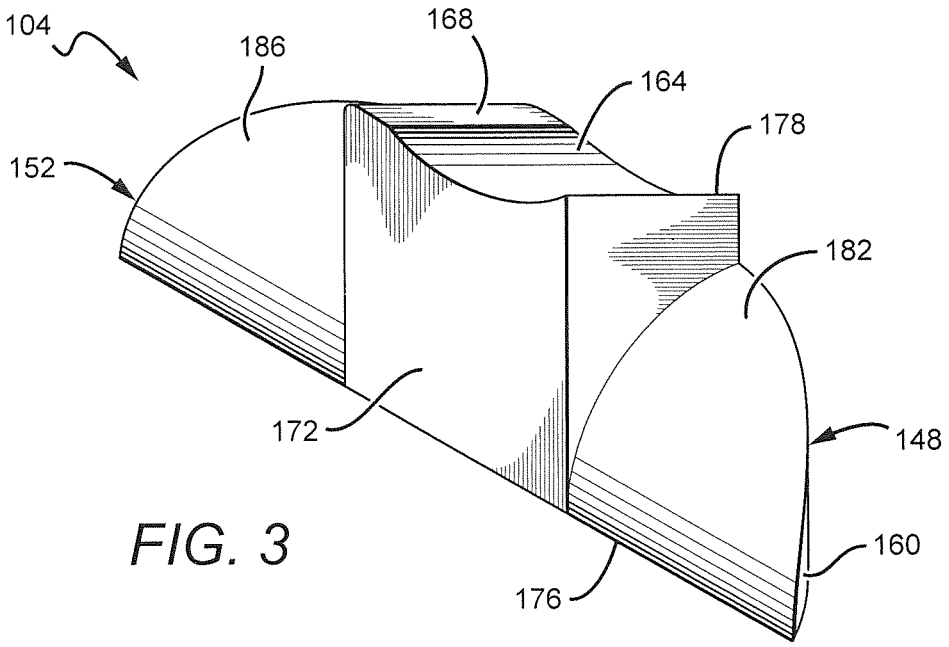
FIG. 3
FIG. 4
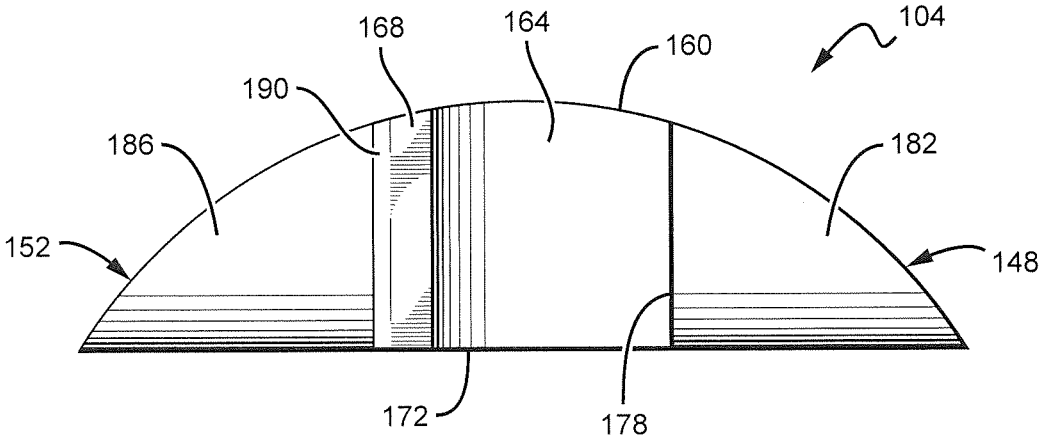

SPRAYER NOZZLE SUPPORT

PRIORITY

This application claims the benefit of and is a continuation of U.S. patent application Ser. No. 14/857,672, filed Sep. 17, 2015, which claims the benefit of priority to U.S. Provisional Application No. 62/053,664, filed Sep. 22, 2014, both entitled "Sprayer Nozzle Support". The entirety of said applications are incorporated herein by reference.

FIELD

The field of the present invention generally relates to trigger spraying assemblies. More particularly, the field of the invention relates to an apparatus and a method for supporting a pump mechanism of a trigger sprayer assembly.

BACKGROUND

A trigger sprayer generally comprises a trigger sprayer assembly which is screwed onto a neck of a fluid-filled container with a dip tube extending from the fluid to the trigger sprayer assembly. Typically, the trigger sprayer assembly is configured for grasping in a user's hand, such that the user may operate the sprayer by pulling the trigger with one or more fingers. Pulling the trigger pushes a piston within a cylinder, which simultaneously forces a portion of fluid drawn from the container into a spray nozzle, thereby dispensing the portion of fluid in the form of a spray or mist. Releasing the trigger draws another portion of fluid from the container, through the dip tube, into the trigger sprayer assembly in preparation for the next time the user moves the trigger.

A drawback to conventional trigger sprayer assemblies is that as the trigger is used to move the piston, the cylinder experiences a degree of stress as force is applied to the piston so as to spray the fluid. The force on the piston and the cylinder depends on the viscosity of the fluid being sprayed. For instance, if the fluid being sprayed is relatively viscous, such as is the case of various oils, then a relatively greater force must be applied to the trigger to dispense the fluid. With continual use, the stress causes the cylinder to eventually fatigue and bend out of shape, thereby rendering the spray nozzle assembly inoperable. Another drawback is that various impacts or other forces may be imparted to the trigger during shipping of the trigger sprayer, causing damage to the piston-cylinder mechanism. Damage to the trigger and the piston-cylinder mechanism often renders the trigger sprayer inoperable and may additionally lead to the fluid leaking out of the container during shipping. What is needed, therefore, is an apparatus and a method for providing support to the piston-cylinder mechanism of trigger sprayers so as to minimize damage due to impacts and materials fatigue.

SUMMARY

An apparatus and a method are provided for a sprayer nozzle support for a pump mechanism of a trigger sprayer assembly comprising a trigger operated piston moving within a cylinder. The sprayer nozzle support generally comprises a tower portion and a first and second side protrusions. The tower portion is configured to convey stability to the cylinder when a screw cap of the trigger sprayer assembly is screwed onto a neck of a container. In some embodiments, the tower portion is further configured to lock the trigger in an initial position so as to prevent damage to the piston and the cylinder due to impacts during shipping of the trigger sprayer assembly from a manufacturer. A top of the tower portion is configured to support the cylinder, and a bottom of the tower portion is configured to contact the screw cap. In an embodiment, the top of the tower portion comprises a raised channel configured to interface with an exterior of the cylinder. The raised channel includes a flat strip comprising an edge of the raised channel which is lower relative to an opposite edge of the raised channel. The flat strip facilitates removing the cylinder from the raised channel, thereby facilitating removal of the sprayer nozzle support from the trigger sprayer assembly. The first and second side protrusions provide structures whereby the sprayer nozzle support may be removed from the trigger sprayer assembly by grasping the sprayer nozzle support between an index finger and a thumb. The first and second side protrusions each comprises a curved distal surface configured to minimize interference with components and structures within the trigger sprayer assembly. A curved proximal surface of the tower portion and the first and second side protrusions facilitates an unobstructed grasping of the trigger sprayer assembly in a hand.

In an exemplary embodiment, an apparatus for providing support to a pump mechanism of a trigger sprayer assembly comprising a trigger operated piston moving within a cylinder comprises a tower portion configured to convey stability to the cylinder when a screw cap of the trigger sprayer assembly is screwed onto a neck of a container, a top of the tower portion being configured to support the cylinder, and a bottom of the tower portion being configured to contact the screw cap; a first and a second side protrusions positioned on opposite sides of the tower portion, wherein the first and the second side protrusions are configured to provide structures whereby the apparatus may be installed and removed from the trigger sprayer assembly by grasping the apparatus between an index finger and a thumb; and a curved proximal surface bounding the tower portion and the first and the second side protrusions, such that the apparatus has a curvature which resembles a curvature of the screw cap, thereby facilitating an unobstructed grasping of the trigger sprayer assembly in a hand.

In another exemplary embodiment, the top of the tower portion comprises a raised channel configured to interface with an exterior of the cylinder. In another exemplary embodiment, the raised channel comprises a rounded cross-sectional shape including a radius which substantially matches an exterior radius of the cylinder. In another exemplary embodiment, the raised channel further comprises a flat strip comprising an edge of the raised channel which is lower relative to an opposite edge of the raised channel, wherein the flat strip facilitates removing the cylinder from the raised channel, thereby enabling removal of the apparatus from the trigger sprayer assembly. In another exemplary embodiment, the flat strip further comprises a rounded edge to further facilitate installation and removal of the apparatus from the trigger sprayer assembly. In another exemplary embodiment, the raised channel is configured with an upward angle in passing from the curved proximal surface to a flat distal surface, the upward angle being substantially equal to an angle between the cylinder and a top of the screw cap.

In another exemplary embodiment, the first and the second side protrusions are configured to maintain the tower portion optimally positioned between the screw cap and the cylinder. In another exemplary embodiment, each of the first and the second side protrusions comprises a curved distal surface configured to minimize interference with components and structures within the trigger sprayer assembly. In another exemplary embodiment, the curved distal surfaces facilitate removal of the apparatus from the trigger sprayer assembly.

In another exemplary embodiment, the tower portion is further configured to lock the trigger in an initial position so as to prevent damage to the piston and the cylinder due to materials fatigue and impacts during shipping of the apparatus. In another exemplary embodiment, the tower portion is fabricated as a extension of the cylinder, such that the tower portion supports the cylinder when the screw cap of the trigger sprayer assembly is screwed onto the neck of the container.

In an exemplary embodiment, a method for providing support to a pump mechanism of a trigger sprayer assembly comprising a trigger operated piston moving within a cylinder comprises configuring a top of a tower portion to support the cylinder when a bottom of the tower portion contacts the screw cap, such that the tower portion conveys stability to the cylinder when the screw cap of the trigger sprayer assembly is screwed onto a neck of a container; forming a first and a second side protrusions on opposite sides of the tower portion, such that the first and the second side protrusions provide structures whereby the tower portion may be installed and removed from the trigger sprayer assembly by grasping the first and the second side protrusions between an index finger and a thumb; and curving a proximal surface the tower portion and the first and the second side protrusions, such that a curved proximal surface of the tower portion and the first and the second side protrusions has a curvature which resembles a curvature of the screw cap, thereby facilitating an unobstructed grasping of the trigger sprayer assembly in a hand.

In another exemplary embodiment, configuring the top of the tower portion further comprises forming a raised channel to interface with an exterior of the cylinder, wherein the raised channel further comprises a flat strip comprising an edge of the raised channel which is lower relative to an opposite edge of the raised channel, wherein the flat strip facilitates removing the cylinder from the raised channel, thereby enabling removal of the apparatus from the trigger sprayer assembly. In another exemplary embodiment, forming the raised channel further comprises forming an upward angle in passing from the curved proximal surface to a flat distal surface, the upward angle being substantially equal to an angle between the cylinder and a top of the screw cap. In another exemplary embodiment, forming the first and the second side protrusions further comprises curving a distal surface of each of the first and the second side protrusions so as to minimize interference with components and structures within the trigger sprayer assembly.

BRIEF DESCRIPTION OF THE DRAWINGS

The drawings refer to embodiments of the present invention in which:

FIG. 1 illustrates an exemplary use environment, wherein a trigger sprayer assembly comprises a sprayer nozzle support in accordance with the present invention;

FIG. 2 illustrates an front upper perspective view of an exemplary embodiment of a sprayer nozzle support in accordance with the present invention;

FIG. 3 illustrates a rear upper perspective view of an exemplary embodiment of a sprayer nozzle support, according to the present invention; and FIG. 4 illustrates a top view of an exemplary embodiment of a sprayer nozzle support in accordance with the present invention.

While the present invention is subject to various modifications and alternative forms, specific embodiments thereof have been shown by way of example in the drawings and will herein be described in detail. The invention should be understood to not be limited to the particular forms disclosed, but on the contrary, the intention is to cover all modifications, equivalents, and alternatives falling within the spirit and scope of the present invention.

DETAILED DISCUSSION

In the following description, numerous specific details are set forth in order to provide a thorough understanding of the present invention. It will be apparent, however, to one of ordinary skill in the art that the present invention may be practiced without these specific details. In other instances, well known components or methods have not been described in detail but rather in a block diagram, or a schematic, in order to avoid unnecessarily obscuring the present invention. Further specific numeric references such as "first driver," may be made. However, the specific numeric reference should not be interpreted as a literal sequential order but rather interpreted that the "first driver" is different than a "second driver." Thus, the specific details set forth are merely exemplary. The specific details may be varied from and still be contemplated to be within the spirit and scope of the present invention. The term "coupled" is defined as meaning connected either directly to the component or indirectly to the component through another component.

In general, the present invention describes an apparatus and a method for a sprayer nozzle support for a pump mechanism of a trigger sprayer assembly comprising a trigger operated piston moving within a cylinder. The sprayer nozzle support generally comprises a tower portion and a first and second side protrusions. The tower portion is configured to convey stability to the cylinder when a screw cap of the trigger sprayer assembly is screwed onto a neck of a container. In some embodiments, the tower portion is further configured to lock the trigger in an initial position so as to prevent damage to the piston and the cylinder due to impacts during shipping of the trigger sprayer assembly from a manufacturer. A top of the tower portion is configured to support the cylinder, and a bottom of the tower portion is configured to contact the screw cap. In an embodiment, the top of the tower portion comprises a raised channel configured to interface with an exterior of the cylinder. The raised channel includes a flat strip comprising an edge of the raised channel which is lower relative to an opposite edge of the raised channel. The flat strip facilitates removing the cylinder from the raised channel, thereby facilitating removal of the sprayer nozzle support from the trigger sprayer assembly. The first and second side protrusions provide structures whereby the sprayer nozzle support may be removed from the trigger sprayer assembly by grasping the sprayer nozzle support between an index finger and a thumb. The first and second side protrusions each comprises a curved distal surface configured to minimize interference with components and structures within the trigger sprayer assembly. A curved proximal surface of the tower portion and the first and second side protrusions facilitates an unobstructed grasping of the trigger sprayer assembly in a hand.

FIG. 1 illustrates a lower perspective view of an exemplary use environment 100 in which a sprayer nozzle support 104 is installed onto a trigger sprayer assembly 108 in accordance with the present invention. It should be understood that the illustrated trigger sprayer assembly 108 is a generic, exemplary trigger sprayer comprising essentially the same components as are commonly utilized in a large variety of trigger-type sprayers. The trigger sprayer assembly 108 comprises a pump mechanism 112 in mechanical communication with a trigger 116, a spray nozzle 120, a sprayer housing 124, and a screw cap 128 rotatably attached to the sprayer housing 124. The sprayer housing 124 serves as a mechanical envelope which contains all those certain internal components comprising the trigger sprayer assembly 108, as well as providing a smooth exterior surface suitable for comfortably grasping the sprayer in a hand. The screw cap 128 has an outer cylindrical surface 132 and an inner cylindrical surface 136, which is provided with internal threads adapted to engage external threads on a neck of a container (not shown) so that the screw cap 128 may be suitably screwed onto and off of the container. A dip tube (not shown) typically extends from the trigger sprayer assembly 108, through the screw cap 128 into a fluid within the container, such that the pump mechanism 112 is in fluid communication with the fluid.

During operation of the trigger sprayer assembly 108, the trigger 116 is pressed toward the pump mechanism 112, which pushes a piston 140 fitted within a cylinder 144. As the piston 140 moves, a dosage of fluid previously drawn into the pump mechanism 112 is pushed into the spray nozzle 120 and discharged therefrom in the form of a spray or mist. When the trigger 116 is released, an internal spring mechanism (not shown) moves the trigger away from the pump mechanism 112 back to an initial position as shown in FIG. 1. While the trigger 116 moves away from the pump mechanism 112, a dosage of fluid is drawn from the container, through the dip tube, and into the pump mechanism 112 in preparation for the next time the trigger 116 is pressed.

The sprayer nozzle support 104 is positioned between the cylinder 144 and an upper surface of the screw cap 128. The sprayer nozzle support 104 preferably is a solid rigid material, such as any of various rigid plastics, or other similar materials. In some embodiments, the sprayer nozzle support 104 may be fabricated as a extension of the cylinder 144, and thus is not removable from the trigger sprayer assembly 108. In the illustrated embodiment, however, the sprayer nozzle support 104 is configured as a separate, removable component which may be used in conjunction with the trigger sprayer assembly 108 to support the cylinder 144, thereby extending a service life of the trigger sprayer assembly 108. In other embodiments, the sprayer nozzle support 104 may be further configured to lock the trigger 116 in the initial position shown in FIG. 1, thereby preventing damage to the pump mechanism 112 due to impacts during shipping of the trigger sprayer assembly 108 from a manufacturer.

As shown in FIGS. 2-4, the sprayer nozzle support 104 generally comprises side protrusions 148 and 152 positioned on opposite sides of an intervening tower portion 156. The side protrusions 148 and 152 are configured to provide structures whereby the sprayer nozzle support 104 may be removed from the trigger sprayer assembly 108 by an end-user grasping the sprayer nozzle support 104 between an index finger and a thumb. Further, the side protrusions 148 and 152 are configured to provide lateral stability to the sprayer nozzle support 104 so as to maintain the tower portion 156 optimally positioned between the screw cap 128 and the cylinder 144. In one embodiment, each of the side protrusions 148 and 152 extends laterally from the tower portion 156 by a distance of substantially 9.1 millimeters (mm). In another embodiment, the side protrusions 148 and 152 have a tip-to-tip extension of substantially 27.1 mm. In other embodiments, however, the side protrusions 148 and 152 need not share equal distances, nor have similar shapes as illustrated in FIGS. 2-4. For instance, in some embodiments of the trigger sprayer assembly 108, wherein the cylinder 144 is not positioned directly behind the trigger 116, the side protrusions 148 and 152 may have different shapes and sizes so as to support the cylinder 144 while also conforming to the exterior curvature of the screw cap 128.

The tower portion 156 is configured to convey stability of the screw cap 128, when screwed onto the neck of the container, to the underside of the cylinder 144. The specific shapes and dimensions comprising the tower portion 156 will vary depending upon the specific shapes and dimensions incorporated into the trigger sprayer assembly 108, particularly the cylinder 144 and the screw cap 128. In the embodiment illustrated in FIGS. 1-4, the tower portion 156 comprises a raised channel 164 and a flat strip 168. The raised channel 164 is configured to interface with the cylinder 144, as shown in FIG. 1, and thus the raised channel 164 comprises a rounded cross-sectional shape. Accordingly, the raised channel 164 preferably has a radius which substantially matches an exterior radius of the cylinder 144. In one embodiment, the radius of the raised channel 164 is substantially 7.5 mm. In other embodiments, however, the radius of the raised channel 164 will vary, depending on the exterior curvature of the cylinder 144 as well as the relative positions of other components which may comprise the pump mechanism 112.

With reference to FIG. 2, the flat strip 168 comprises an edge of the raised channel 164 which is lower relative to an opposite edge 178 of the raised channel 164. Those skilled in the art will recognize that the flat strip 168 advantageously facilitates removing the cylinder 144 from the raised channel 164, thereby facilitating installation and removal of the sprayer nozzle support 104 from the trigger sprayer assembly 108. In the embodiment depicted in FIG. 4, the flat strip 168 further comprises a rounded edge 190. The rounded edge 190 further facilitates installation and removal of the sprayer nozzle support from the trigger sprayer assembly 108. In one exemplary embodiment, the rounded edge 190 has a radius of 5.0 mm. Further, in one embodiment, the flat strip 168 is lower than the opposite edge 178 of the raised channel 164 by a distance of substantially 1.1 mm. In another embodiment, the opposite edge 178 has a maximal height of substantially 11.2 mm above a flat bottom surface 176 of the spray nozzle support 104. In another embodiment, the flat strip 168 has a maximal height of substantially 10.1 mm above the flat bottom surface 176 of the spray nozzle support 104. In some embodiments, in which the sprayer nozzle support 104 is not intended to be removed from the trigger sprayer assembly 108, the flat strip 168 may be omitted from the tower portion 156.

As most clearly illustrated in FIGS. 2-3, the raised channel 164 is configured with an upward angle in passing from a curved proximal surface 160 to a flat distal surface 172, relative to the flat bottom surface 176 of the sprayer nozzle support 104. As shown in FIG. 1, the flat bottom surface 176 is configured to sit flatly on top of the screw cap 128, and thus the value of the upward angle depends upon an angle of the cylinder 144 relative to the top of the screw cap 128. In the illustrated embodiment, the upward angle of the raised channel 164 is substantially 26.6 degrees relative to the top surface of the screw cap 128. In another embodiment, wherein the tower portion 156 has a distal extent of substantially 7.5 mm, the upward angle has a value such that the channel 164 rises by substantially 3.8 mm in passing from the curved proximal surface 160 to the flat distal surface 172. In other embodiments, however, the upward angle generally will depend upon the orientation of the cylinder 144 relative to the screw cap 128 and other nearby components within the trigger sprayer assembly 108.

As shown in FIGS. 2-4, the curved proximal surface 160 bounds the tower portion 156 and the side protrusions 148 and 152, such that the sprayer nozzle support 104 has a curvature which resembles the curvature of the screw cap 128. Those skilled in the art will appreciate that the curved proximal surface 160 eliminates protrusions that would otherwise interfere with the end-user comfortably grasping the trigger sprayer assembly 108, as well as obstructing proper operation of the trigger 116 during use of the trigger sprayer assembly 108. Accordingly, the curved proximal surface 160 comprises a radius selected to resemble the curvature of the outer cylindrical surface 132 of the screw cap 128. In one embodiment, the radius of the curved proximal surface 160 is substantially 16.0 mm. In other embodiments, the specific value of the radius selected for the curved proximal surface 160 will vary depending upon the position of the cylinder 144 within the trigger sprayer assembly 108 relative to the screw cap 128.

As best shown in FIG. 3, each of the side protrusions 148 and 152 comprises a curved distal surface 182 and 186, respectively. The curved distal surfaces 182 and 186 respectfully provide a smooth finish to each of the side protrusions 148 and 152 so as to minimize interference with components and structures which may exist within the sprayer housing 124. The curved distal surfaces 182 and 186 further provide smooth surfaces suitable for contact with the end-user's fingers, thereby facilitating removal of the sprayer nozzle support 104 from the trigger sprayer assembly 108 by the end-user.

While some specific embodiments of the present invention have been shown the invention is not to be limited to these embodiments. For example, most functions performed by electronic hardware components may be duplicated by software emulation. Thus, a software program written to accomplish those same functions may emulate the functionality of the hardware components in input-output circuitry. The present invention is to be understood as not limited by the specific embodiments described herein, but only by scope of the appended claims.

What is claimed is:

1. An apparatus for providing support to a pump mechanism of a trigger sprayer assembly, comprising a trigger operated piston moving within a cylinder, the apparatus comprising:

a tower portion including:

(i) a top portion including a raised channel configured to support a cylinder, and (ii) a bottom portion being configured to contact a screw cap wherein the at least a top of the tower portion being configured to support the cylinder, and a bottom of the tower portion being configured to contact the screw cap;

a first side protrusion positioned on a first side of the tower portion;

a second side protrusion positioned on a second side of the tower portion opposite the first side; and a curved proximal surface bounding the tower portion, the first side protrusion and the second side protrusion, wherein the raised channel further comprises a flat strip configured to facilitate removal of the apparatus from the trigger sprayer assembly, the flat strip comprising an edge of the raised channel being relatively lower to an opposing edge of the raised channel.

2. The apparatus of claim 1, wherein the first side protrusion and the second side protrusion are configured to maintain the tower portion positioned between the screw cap and the cylinder.

3. The apparatus of claim 1, wherein the raised channel is further configured to interface with an exterior of the cylinder.

4. The apparatus of claim 3, wherein the raised channel further comprises a rounded cross-sectional shape including a radius which substantially matches an exterior radius of the cylinder.

5. The apparatus of claim 1, wherein the flat strip further comprises a rounded edge to further facilitate installation and removal of the apparatus from the trigger sprayer assembly.

6. The apparatus of claim 3, wherein the raised channel is further configured with an upward angle in passing from a curved proximal surface to a flat distal surface, the upward angle being substantially equal to an angle between the cylinder and a top of the screw cap.

7. The apparatus of claim 1, wherein each of the first side protrusion and the second side protrusion comprises a curved distal surface configured to reduce interference with components and structures within the trigger sprayer assembly.

8. The apparatus of claim 7, wherein the curved distal surfaces also facilitate removal of the apparatus from the trigger sprayer assembly.

9. The apparatus of claim 1, wherein the tower portion is fabricated as a extension of the cylinder, such that the tower portion supports the cylinder when the screw cap of the trigger sprayer assembly is screwed onto the neck of the container.

* * * * *